United States Patent [19]

Töpfl

[11] Patent Number: 4,563,190

[45] Date of Patent: Jan. 7, 1986

[54] DYEING ASSISTANT AND USE THEREOF FOR DYEING OR PRINTING SYNTHETIC POLYAMIDE FIBRE MATERIAL

[75] Inventor: Rosemarie Töpfl, Dornach, Switzerland

[73] Assignee: Ciba-Geigy Corporation, Ardsley, N.Y.

[21] Appl. No.: 528,027

[22] Filed: Aug. 31, 1983

[30] Foreign Application Priority Data

Mar. 9, 1982 [CH] Switzerland ..... 5249/82

[51] Int. Cl.[4] ..... D06P 1/56; D06P 3/24; C09B 67/26

[52] U.S. Cl. ..... 8/524; 8/557; 8/589; 8/606; 8/680; 8/924; 8/581

[58] Field of Search ..... 8/557, 606, 524, 589

[56] References Cited

U.S. PATENT DOCUMENTS

| | | | |
|---|---|---|---|
| 3,062,609 | 11/1962 | Abel | 8/560 |
| 3,097,040 | 7/1963 | Casty | 8/543 |
| 3,118,723 | 1/1964 | Harding | 8/549 |
| 3,684,426 | 8/1972 | Bladler | 8/480 |
| 3,995,996 | 12/1976 | Pantke et al. | 8/551 |
| 4,121,898 | 10/1978 | Kirschnek et al. | 8/641 |
| 4,295,852 | 10/1981 | Walz et al. | 8/560 |
| 4,302,202 | 11/1981 | Sumner et al. | 8/455 |
| 4,322,372 | 3/1982 | Wurmli et al. | 8/658 |
| 4,365,967 | 12/1982 | Guth et al. | 8/477 |
| 4,384,976 | 5/1983 | Grunert et al. | 252/321 |
| 4,410,331 | 10/1983 | Wurmli et al. | 8/589 |
| 4,444,563 | 4/1984 | Abel | 8/588 |

FOREIGN PATENT DOCUMENTS

| | | |
|---|---|---|
| 74923 | 3/1983 | European Pat. Off. . |
| 1299777 | 12/1972 | United Kingdom . |
| 1396126 | 6/1975 | United Kingdom . |

*Primary Examiner*—A. Lionel Clingman

*Attorney, Agent, or Firm*—Edward McC. Roberts; Kevin T. Mansfield

[57] ABSTRACT

The invention relates to a dyeing assistant comprising at least (A) a sulfonated condensation product of a hydroxyaryl compound and formaldehyde or a sulfonated N-arylmelamine derivative, and (B) a quaternary ammonium compound which contains at least one basic nitrogen atom to which are attached at least one polyglycol ether chain and at least one aliphatic radical of 10 to 22 carbon atoms, said polyglycol ether chain containing at least one grouping of the formula

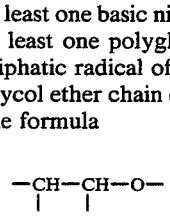

(1)

preferably a grouping of the formula

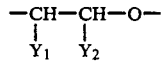

(2)

wherein one of $Y_1$ and $Y_2$ is hydrogen and the other is the phenyl radical, and optionally (C) a siloxane/oxyalkylene copolymer and/or (D) a polar solvent.

This dyeing assistant is used in particular for dyeing or printing synthetic polyamide fibre material with anionic dyes.

23 Claims, No Drawings

DYEING ASSISTANT AND USE THEREOF FOR DYEING OR PRINTING SYNTHETIC POLYAMIDE FIBRE MATERIAL

The present invention relates to a novel dyeing assistant and to the use thereof for dyeing or printing synthetic polyamide fibre material with anionic dyes.

The present invention has for its object to provide a dyeing assistant which acts as levelling agent when dyeing synthetic polyamide fibre material in the temperature range from 50° to 102° C., and thereby prevents barriness caused by the material.

Surprisingly, there has now been found a novel dyeing assistant which not only meets the above requirements, but also ensures a level penetration of the dye into the fibre material and increased migration of the dye, so that an improvement in the levelness of the dyeings and a good bath exhaustion are achieved.

Accordingly, the invention provides a novel assistant mixture which comprises at least (A) a sulfonated condensation product of hydroxyaryl compounds and formaldehyde or a sulfonated N-arylmelamine derivative, and (B) a quaternary ammonium compound which contains at least one basic nitrogen atom to which are attached at least one polyglycol ether chain and at least one aliphatic radical of 10 to 22 carbon atoms, said polyglycol ether chain containing at least one grouping of the formula

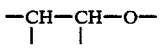

(1)

or preferably at least one grouping of the formula

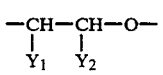

(2)

wherein one of $Y_1$ and $Y_2$ is hydrogen and the other is the phenyl radical.

The quaternary ammonium compound preferably contains two polyglycol ether chains which together contain 4 to 200, especially 6 to 100 groupings of the formula (1), of which preferably one or two are the grouping of the formula (2).

In addition to components (A) and (B), the assistant mixture of the invention may also contain (C) a siloxane/oxyalkylene copolymer and (D) a polar solvent.

Components (A), (B), (C) and (D) may be present as individual compounds or as mixtures. Preferred assistant mixtures consist of all the components (A), (B), (C) and (D).

The sulfonated condensation products of hydroxyaryl compounds and formaldehyde suitable for use as component (A) are known per se and have substantially the formula

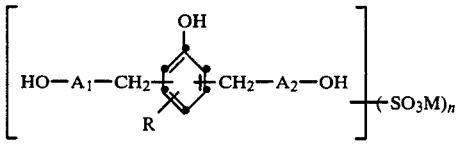

(3)

wherein each of $A_1$ and $A_2$ independently of the other is a naphthylene radical or preferably a phenylene radical which is unsubstituted or substituted by halogen, alkyl, cycloalkyl, aryl or aralkyl, R is halogen, alkyl, cycloalkyl, aryl or aralkyl, M is hydrogen or a salt-forming cation, and n is a value from 1 to 3. $A_1$ and $A_2$ are preferably identical.

Alkyl is preferably a $C_1$–$C_{12}$alkyl radical which may be straight chain or branched. Examples of such radicals are: methyl, ethyl, isopropyl, tert-butyl, pentyl, isoamyl, tert-amyl, n-hexyl, n-octyl, isooctyl, tert-octyl, nonyl, isononyl, decyl or dodecyl.

Cycloalkyl is preferably a $C_5$–$C_6$cycloalkyl radical, e.g. cyclopentyl or preferably cyclohexyl. Aryl is e.g. phenyl substituted by methyl, methoxy or halogen, or is preferably unsubstituted phenyl. Aralkyl is e.g. benzyl or α-methylbenzyl. Halogen is e.g. fluorine, bromine or preferably chlorine.

A salt-forming cation M is e.g. an alkyli metal such as sodium or potassium, an alkaline earth metal such as calcium or magnesium, or is ammonium ($NH_4$) or an ammonium group which is derived e.g. from an aliphatic amine, e.g. diethylamine or triethylamine or monoethanolamine, diethanolamine or triethanolamine, or also from a heterocyclic amine, e.g. piperidine, morpholine or pyridine.

Preferred sulfonated formaldehyde condensation products are derived only from hydroxyaryl compounds of the benzene series and have the formula

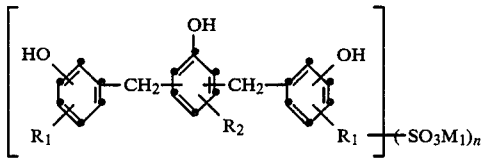

(4)

wherein each of $R_1$ and $R_2$ independently of the other is halogen, $C_1$–$C_{12}$alkyl, cyclohexyl, benzyl or phenyl, and $R_1$ is also hydrogen, $M_1$ is hydrogen, an alkali metal or ammonium, and n is a value from 1 to 3. $R_1$ is preferably $C_1$–$C_9$alkyl and is most preferably tert-butyl.

Particularly suitable sulfonated formaldehyde condensation products have the formula

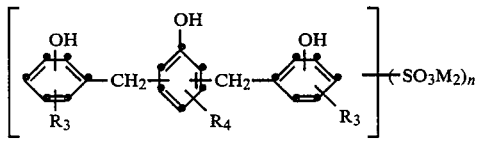

(5)

wherein each of $R_3$ and $R_4$ independently of the other is $C_1$–$C_9$ alkyl, in particular methyl, tert-butyl or nonyl, and $R_3$ is also hydrogen, $M_2$ is hydrogen, sodium, potassium or ammonium, and n is a value from 1 to 3. $R_3$ is preferably tert-butyl.

The preparation of the sulfonated formaldehyde condensation products from hydroxyaryl compounds is carried out in a manner known per se. The preferred method comprises reacting 1 mole of a dimethylolphenol compound of the formula

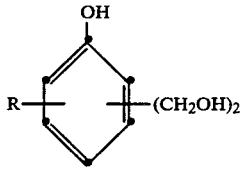

(6)

with 1 mole of a hydroxyaryl compound of the formula $$HO—A_1—H \quad (7a)$$

and 1 mole of a hydroxyaryl compound of the formula $$HO—A_2—H \quad (7b)$$

in the presence of an acid catalyst and conveniently in the temperature range from 50° to 100° C., and treating the condensation product so obtained of the formula

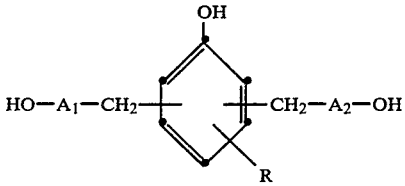

(8)

with a sulfonating agent and, if desired, converting the resultant sulfonic acid into the above salts.

In the phenol compounds of the formulae (6) and (8), the substituent R may be in the ortho- or para-position and the phenol compounds may be in the form of mixtures of isomers.

Sulfonated formaldehyde condensation products of the formulae (3) to (5) and the preparation thereof are described e.g. in German Auslegeschrift No. 2 328 767 or in German patent specification No. 1 248 609.

Sulfonated N-arylmelamine derivatives are also suitable for use as component (A). These compounds are preferably melamine compounds of the formula

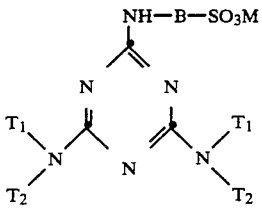

(9)

wherein B is an α- or β-naphthylene radical, $T_1$ is hydrogen or $C_1$–$C_5$ alkyl, preferably methyl or ethyl, and $T_2$ is phenyl or phenyl substituted by halogen, $C_1$–$C_4$alkyl, e.g. methyl, or $C_1$–$C_4$alkoxy, e.g. methoxy, and M is hydrogen or a salt-forming cation.

The sulfonated melamine compounds of the formula (9) are prepared in a manner which is known per se, for example by reacting a cyanuric halide such as cyanuric bromide, cyanuric fluoride, or preferably, cyanuric chloride, in any order, with sulfonated α- or β-naphthylamine and an amine of the formula (10)

$$HNT_1T_2 \quad (10)$$

The reaction is preferably carried out in a strongly dilute aqueous-organic medium and, depending on the halogen substituents, conveniently in the temperature range from 0° to 100° C. and in the pH range from 6 to 8, preferably in the presence of a mineral acid acceptor, e.g. sodium carbonate, potassium carbonate, potassium hydroxide or sodium hydroxide.

The quaternary ammonium compounds employed in the assistant mixture as component (B) are also known per se and can be prepared in a manner which is known per se, e.g. by reacting corresponding aliphatic amines whose alkyl or alkenyl moieties contain 10 to 22 carbon atoms, e.g. dodecylamine, hexadecylamine, heptadecylamine, octadecylamine, tallow fatty amine, arachidylamine, behenylamine or oleylamine, or di- or triamines, e.g. dodecylpropylenediamine, octadecylethylenediamine or octadecyl-diethylenetriamine, with 1 to 200 moles, preferably 1 to 100 moles, of an alkylene oxide, e.g. propylene oxide, but preferably with ethylene oxide, or with a mixture of propylene oxide and ethylene oxide, or with 1 to 2 moles of styrene oxide and 1 to 45 moles, preferably 3 to 35 moles, of the above alkylene oxides, and by subsequently quaternising the reaction product with a customary quaternising agent, e.g. a methyl, ethyl or benzyl halide, diethyl sulfate or, preferably, dimethyl sulfate, a halohydrin or a halocarboxamide, e.g. chloroacetamide.

Preferred quaternary ammonium compounds are those of the formula

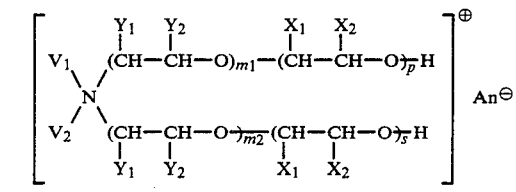

(11)

wherein $V_1$ is alkyl or alkenyl, each of 10 to 22 carbon atoms, $V_2$ is alkyl of 1 to 4 carbon atoms, hydroxyalkyl of 2 to 4 carbon atoms, carbamoylmethyl or benzyl, preferably methyl; one of $Y_1$ and $Y_2$ is hydrogen and the other is phenyl; one of $X_1$ and $X_2$ is hydrogen or methyl and the other is hydrogen; $An^{\ominus}$ is the anion of an inorganic or organic acid, in particular of a strong mineral acid or of an organic sulfonic acid, e.g. the chloride, bromide, sulfate, benzenesulfonate, p-toluenesulfonate, methanesulfonate or ethanesulfonate ion; $m_1$ and $m_2$ are 0 or 1 and p and s are whole numbers, the sum of p+s being from 2 to 40, preferably from 3 to 35.

In formula (11), $V_1$ is preferably alkyl or alkenyl, each of 12 to 18 carbon atoms, most preferably octadecyl or octadecenyl, $X_1$ and $X_2$ are preferably hydrogen, the sum of p+s is preferably from 5 to 25, and one of $m_1$ and $m_2$ is preferably 1 and the other is 0 or 1.

The amounts in which component (B) is present in the assistant mixture alone or in admixture vary from 2 to 30% by weight, preferably from 2 to 20 and most preferably from 2 to 8% by weight, based on the entire mixture.

Preferred assistant mixtures of this invention comprise at least the following components:

(Aa) a sulfonated formaldehyde condensation product of the formula (4)

(Bb) a quaternary ammonium compound of the formula

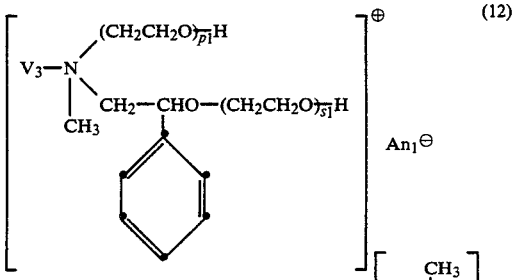

(12)

wherein $V_3$ is octadecyl or octadecenyl and $An_1\ominus$ is the chloride, bromide, methanesulfonate or ethanesulfonate ion, and the sum of $p_1+s_1$ is from 7 to 35, preferably from 15 to 25.

Besides components (A) and (B), the novel dyeing assistant of this invention may additionally contain, as component (C), a siloxaneoxyalkylene copolymer. Component (C) acts in particular as foam inhibitor.

Optional component (C) may be a commercially available surface-active hydrophilic adduct of an organopolysiloxane and ethylene oxide and/or propylene oxide.

The organopolysiloxanes employed as starting materials for obtaining such adducts are, in principle, commercially available silicone oils which are described in German Auslegeschrift No. 20 31 827. Among these silicone oils, polydimethylsiloxanes are preferred. The siloxaneoxyalkylene copolymers suitable for use as optional component (C) may be obtained e.g. from halogen-substituted organopolysiloxanes, in particular polydimethylsiloxanes and alkali metal salts of polyoxyalkylene, e.g. polyethylene and/or polypropylene glycols.

The siloxane-oxyalkylene copolymers used as component (C) are polyether siloxanes which advantageously have a cloud point in the range from about 20°-70° C. preferably from 25°-50° C. The glycol content consisting of oxyethylene groups, or oxyethylene and oxypropylene groups, is advantageously from 35 to 85% by weight, preferably from 40 to 75% by weight, based on the total weight of the polyether siloxane.

A preferred embodiment of the optional component (C) is accordingly a block polymer of a polydimethyl siloxane and ethylene oxide, or of a copolymer of ethylene oxide and propylene oxide, which block polymer has a cloud point of 20°-70° C., preferably from 25°-50° C. Such block polymers or polyether siloxanes may be illustrated by the probable formula

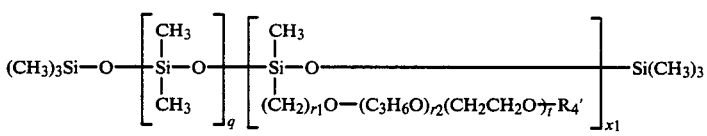

(13)

wherein q is 3 to 50, preferably 3 to 25, $r_1$ is 2 or 3, $r_2$ is 0 to 15, t is 1 to 25, $x_1$ is 3 to 10 and $R_4'$ is alkyl of 1 to 4 carbon atoms, preferably methyl. Such polyether siloxanes are described e.g. in German Auslegeschrift No. 1 719 328 and in U.S. Pat. Nos. 2,834,748, 3,389,160 and 3,505,377.

Further polyether siloxanes which may be used as component (C) have the probable formula

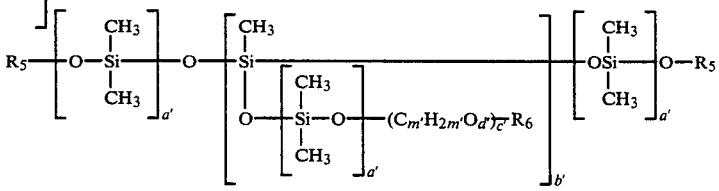

(14)

wherein each of $R_5$ and $R_6$ is alkyl of 1 to 4 carbon atoms, preferably methyl, a' is 1 to 20, b' is 2 to 20, c' is 2 to 50, d' is 1 or 2, preferably 1, and m' is 2 to 5, and the groups $C_{m'}H_{2m'}O_{d'}$ are preferably ethylene oxide groups or mixtures of ethylene oxide groups and propylene oxide groups. Such siloxane compounds are described in German Auslegeschrift No. 1 795 557.

A suitable optional component (C) which corresponds to the probable formula (13) and has a cloud point of 32° C., is e.g. SILICONSURFACTANT L 546® (registered trademark of Union Carbide). This silicone compound is used preferably in conjunction with propylene glycol.

In addition, the assistants of this invention may contain, as polar solvent (D), water or a water-miscible organic solvent. The addition of solvent improves the solubility of the composition. Examples of water-miscible organic solvents are aliphatic $C_1$-$C_4$ alcohols such as methanol, ethanol, the propanols or isobutanol; alkylene glycols such as ethylene glycol or propylene glycol; monoalkyl ethers of glycols such as ethylene glycol monomethyl, monoethyl or monobutyl ether, and diethylene glycol monomethyl or monoethyl ether; ketones such as acetone, methyl ethyl ketone, cyclohexanone or diacetone alcohol; ethers and acetals such as diisopropyl ether, diphenyl oxide, dioxan, tetrahydrofuran, and also tetrahydrofurfuryl alcohol, pyridine, acetonitrile, γ-butyrolactone, N-methylpyrrolidone, N,N-dimethylformamide, N,N-dimethylacetamide, tetramethylurea, tetramethylene sulfone etc. Mixtures of these solvents may also be used. The preferred solvent is water or propylene glycol or, in particular, a mixture thereof, preferably in a weight ratio of water to propylene glycol of 15:1 to 3:1.

The assistant compositions employed in the practice of this invention may be prepared by simple stirring of the components (A), (B) and optionally (C). The addition of component (D), preferably water, and optionally also of a base, e.g. an alkali metal hydroxide such as sodium hydroxide or potassium hydroxide, or a lower alkanolamine such as monoethanolamine, diethanolamine or triethanolamine, gives homogeneous, preferably clear mixtures which are very stable at room temperature.

The assistant compositions advantageously comprise
15 to 70% by weight of component (A),
2 to 30% by weight of component (B),
0 to 5% by weight, preferably 0.5 to 2% by weight, of component (C),
0 to 70% by weight, preferably 30 to 60% by weight, of component (D), and
0 to 15% by weight, preferably 2 to 10% by weight, of a base,
in each case based on the weight of the composition.

The novel formulations are used in particular as levelling and retarding agents for dyeing synthetic polyamide fibre materials. They accordingly make it possible to obtain completely level dyeings and, in addition, to give non-barry dyeings on the substrate.

Accordingly, the present invention also provides a process for dyeing or printing synthetic polyamide fibre material with anionic dyes, which process comprises dyeing or printing said material in the presence of the dyeing assistant of the invention.

The amount in which the dyeing assistant is added to the dyebath is in the range from 1 to 10% by weight, preferably from 2 to 5% by weight, based on the weight of the material to be dyed.

Suitable polyamide fibre materials, in particular textile materials, which may be dyed in the presence of the novel dyeing assistant of this invention, are e.g. those made from adipic acid and hexamethylenediamine (polyamide 66), from ε-caprolactam (polyamide 6), from ω-aminoundecanoic acid (polyamide 11), from ω-aminooenanthic acid (polyamide 7), from ω-aminopelargonic acid (polyamide 8) or from sebacic acid and hexamethylenediamine (polyamide 610).

The polyamide fibre materials may also be employed as blends with one another or with other fibres, e.g. blends of polyamide/wool or polyamide/polyester.

The fibre material may be in very different states of processing, for example flocks, tops, wovens, knits, nonwovens, yarn or piece goods. Typical piece goods are in particular floor coverings such as carpets, or other home textiles such as furniture fabrics, curtains or wall coverings.

The anionic dyes are e.g. salts of monoazo, disazo or polyazo dyes which contain heavy metals or are preferably metal-free, including formazane dyes, as well as anthraquinone, xanthene, nitro, triphenylmethane, naphthoquinone-imine and phthalocyanine dyes. The anionic character of these dyes may be imparted by metal complex formation alone and/or preferably by acid salt-forming substituents such as carboxylic acid groups, sulfuric acid ester groups, phosphonic acid ester groups, and phosphonic acid groups or sulfonic acid groups. These dyes may also contain in the molecule reactive groups which form a covalent bond with the substrate to be dyed. Preferred dyes are the so-called acid metal-free dyes. These preferably contain only a single sulfonic acid group and may contain a further water-solubilising group which is not a salt-forming group, e.g. the acid amide or alkylsulfonyl group.

Particularly interesting dyes are also the 1:1 or preferably 1:2 metal complex dyes. The 1:1 metal complex dyes contain preferably one or two sulfonic acid groups. As metal they contain a heavy metal atom, e.g. copper, nickel or, preferably, chromium.

The 1:2 metal complex dyes contain, as central metal atom, a heavy metal atom, e.g. a cobalt or especially a chromium atom. Attached to the central atom are two complexing components, at least one of which, but preferably each of which, is a dye molecule. In addition, both dye molecules participating in the complexing can be identical or different. The 1:2 metal complex dyes may contain e.g. two azomethine molecules, a disazo and a monoazo dye molecule or preferably two monoazo dye molecules. The azo dye molecules may contain water-solubilising groups, e.g. acid amide, alkylsulfonyl, or the above mentioned acid groups. Preferred metal complex dyes are 1:2 cobalt or 1:2 chromium complex dyes of monoazo dyes which contain acid amide or alkylsulfonyl groups or altogether a single sulfonic acid group.

Mixtures of anionic dyes may also be used. Especially preferred are mixtures of at least 2 or 3 anionic dyes for obtaining level dichromatic or trichromatic dyeings.

The amount of dye added to the bath depends on the desired depth of shade. In general, amounts of 0.01 to 10 g/l, especially of 0.1 to 5 g/l, have proved useful.

The dyebaths may contain alkali metal hydroxides, alkali metal carbonates or alkali metal bicarbonates; mineral acids such as sulfuric acid or phosphoric acid; organic acids, preferably lower aliphatic carboxylic acids such as formic acid, acetic acid or oxalic acid, and/or salts such as ammonium acetate, ammonium sulfate, disodium phosphate, dipotassium phosphate, potassium acetate or sodium acetate. The alkalies and acids are used in particular for adjusting the pH value of the dyebaths, said value normally being 4.5 to 8.5, preferably 5 to 8. The dyebaths may additionally contain the customary electrolytes, dispersants, antifoams and wetting agents.

Dyeing is advantageously carried out from an aqueous liquor by the exhaust process. The liquor to goods ratio may accordingly be chosen within a wide range, e.g. from 1:3 to 1:100, preferably from 1:10 to 1:50. Dyeing is conveniently carried out in the temperature range from 40° C. to boiling point (96°–102° C.), preferably from 60° to 96° C.

It is preferred to put the textile material, especially a carpet, into a bath which has a temperature of 15° to 25° C. and a pH value of 7.5 to 8.5. Then the dyes and the assistant composition of the invention are added and the material is treated for 5 to 15 minutes at 15°–25° C. The temperature is then slowly raised to 60°–95° C. and dyeing is performed for 30 to 60 minutes at this temperature. The pH of the bath is then lowered to 5–6, especially over the course of 20 to 60 minutes, and dyeing is continued for 10 to 20 minutes at 90°–95° C. When dyeing is complete, the bath is cooled and the dyed material is rinsed and dried in the usual manner. The dyeing process may also be carried out by first treating the material to be dyed with the assistant composition for 10 to 15 minutes at 20°–25° C. and then dyeing it.

The synthetic polyamide fibre material may also be dyed by a printing or pad process, in which the printing paste, which may contain a thickener, or dye liquor which contains dye, assistant composition, acid and optionally further ingredients, is printed or padded respectively onto the fabric, preferably in the temperature range from 10° to 40° C. The padded or printed fabric may be subjected to a heat treatment, e.g. steaming. The process of the present invention gives level and strong dyeings of good crockfastness and in good yield on synthetic polyamide fibre material. In addition, the use of the assistant composition does not adversely affect the other fastness properties of the dyeings, e.g. the lightfastness.

In contradistinction to conventional processes, the dyeings can be obtained simultaneously using the assistant mixture of the invention without first pretreating the goods and then cooling them. The dye can therefore be used simultaneously with the novel combination composition.

In the following Examples parts and percentages are by weight. The following products are examples of quaternary ammonium compounds which are used as component (B):

$B_1$ the polyadduct of 15 moles of ethylene oxide and 1 mole of laurylamine, quaternised with dimethyl sulfate, $B_2$ the polyadduct of 30 moles of ethylene oxide and 1 mole of laurylamine, quaternised with dimethyl sulfate, $B_3$ the polyadduct of 1 mole of styrene oxide and 18 moles of ethylene oxide with 1 mole of laurylamine, quaternised with methyl chloride, $B_4$ the polyadduct of 1 mole of styrene oxide and 18 moles of ethylene oxide with 1 mole of laurylamine, quaternised with dimethyl sulfate, $B_5$ the polyadduct of 1 mole of styrene oxide, 1 mole of propylene oxide and 15 moles of ethylene oxide with 1 mole of laurylamine, quaternised with dimethyl sulfate, $B_6$ the polyadduct of 1 mole of styrene oxide and 15 moles of ethylene oxide with 1 mole of oleylamine, quaternised with dimethyl sulfate, $B_7$ the polyadduct of 2 moles of styrene oxide and 20 moles of ethylene oxide with 1 mole of oleylamine, quaternised with methyl chloride, $B_8$ the polyadduct of 1 mole of styrene oxide and 20 moles of ethylene oxide with 1 mole of oleylamine, quaternised with dimethyl sulfate, $B_9$ the polyadduct of 2 moles of styrene oxide and 20 moles of ethylene oxide with 1 mole of oleylamine, quaternised with dimethyl sulfate, $B_{10}$ the polyadduct of 1 mole of styrene oxide, 30 moles of ethylene oxide and 10 moles of propylene oxide with 1 mole of oleylamine, quaternised with methyl chloride, $B_{11}$ the polyadduct of 1 mole of styrene oxide, 6 moles of propylene oxide and 30 moles of ethylene oxide with 1 mole of oleylamine, quaternised with dimethyl sulfate, $B_{12}$ the polyadduct of 15 moles of ethylene oxide and 1 mole of stearylamine, quaternised with dimethyl sulfate, $B_{13}$ the polyadduct of 1 mole of styrene oxide and 30 moles of ethylene oxide with 1 mole of stearylamine, quaternised with dimethyl sulfate, $B_{14}$ the polyadduct of 1 mole of styrene oxide and 20 moles of ethylene oxide with 1 mole of stearylamine, quaternised with dimethyl sulfate, $B_{15}$ the polyadduct of 1 mole of styrene oxide, 2 moles of propylene oxide and 24 moles of ethylene oxide with 1 mole of stearylamine, quaternised with dimethyl sulfate, $B_{16}$ the polyadduct of 7 moles of ethylene oxide and 1 mole of tallow fatty amine, quaternised with dimethyl sulfate, $B_{17}$ the polyadduct of 8 moles of ethylene oxide and 1 mole of tallow fatty amine, quaternised with chloroacetamide, $B_{18}$ the polyadduct of 30 moles of ethylene oxide and 1 mole of a $C_{18}$–$C_{22}$fatty amine, quaternised with dimethyl sulfate, $B_{19}$ the polyadduct of 34 moles of ethylene oxide and 1 mole of a $C_{20}$–$C_{22}$fatty amine, quaternised with dimethyl sulfate.

EXAMPLE 1

10 g of a polyamide 66 carpet backed with polypropylene are put into a liquor which contains 0.075 g of 85% formic acid, 0.035 g of a yellow dye of the formula

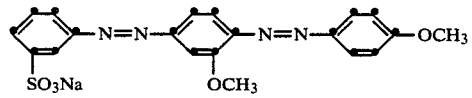

(101)

0.024 g of a red dye of the formula

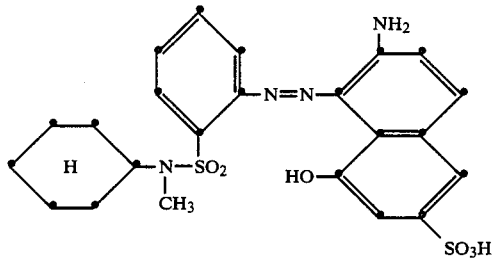

(102)

0.03 g of a blue dye of the formula

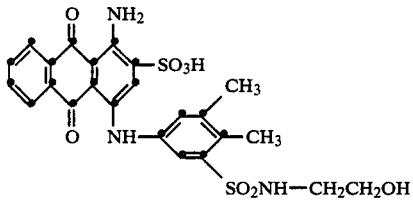

(103)

0.2 g of an assistant composition (1) comprising

36% of a sulfonated phenol/formaldehyde condensate, preferred in accordance with German Auslegeschrift No. 2 328 767, Example 8, 2.8% of the quaternary ammonium compound $B_6$, 1% of a siloxane/oxyalkylene copolymer (A) having a viscosity of 1200 mPas at 20° C. and a cloud point of 32° C., 10% of propylene glycol, 7% of monoethanolamine, 43.2% of water in 400 ml of water. The bath is then warmed to 40° C. and the temperature is raised over 60 minutes to 60° C. and dyeing is performed for 60 minutes at this temperature. The bath is then cooled and the carpet is rinsed and dried. A level dyeing of good penetration is obtained.

EXAMPLE 2

100 kg of polyamide 66 carpet is impregnated at 20° C. in a winchbeck, equipped with metering devices for sodium hydroxide and sulfuric acid, with 3000 liters of water adjusted to pH 8. The following ingredients are then added to the liquor:

2500 g of the assistant composition (1),
200 g of a yellow dye of the formula (101)
300 g of a red dye of the formula (102) and
100 g of a blue dye of the formula (103).

The goods are circulated for 15 minutes at 20° C. and the temperature is then raised over 40 minutes to 60° C. Dyeing is then carried out for 30 minutes at this temperature and the pH of the bath is lowered to 5 by adding sulfuric acid over the course of 40 minutes. Dyeing is carried out for another 15 minutes at 95° C. and pH 5. The dyebath is then cooled and the carpet is rinsed and finished. A level, non-barry dyeing of good penetration is obtained. The bath is almost completely exhausted, so that the next carpet may be dyed in the same dyebath.

Level, non-barry and deep dyeings are also obtained by using in Examples 1 and 2 the same amounts of the following further compositions (2) and (3) respectively, instead of composition (1):

Composition (2) comprising
25% of a sulfonated formaldehyde condensate of the formula

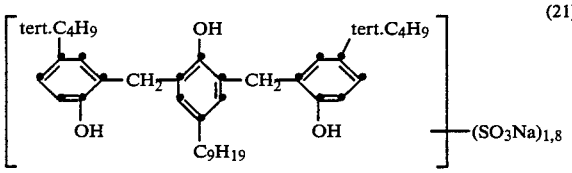

(21)

10% of the quaternary ammonium compound $B_6$
1% of the siloxane/oxyalkylene copolymer (A),
5% of propylene glycol,
7% of 30% sodium hydroxide solution and
52% of water;

Composition (3) comprising
36% of a sulfonated formaldehyde condensate of the formula

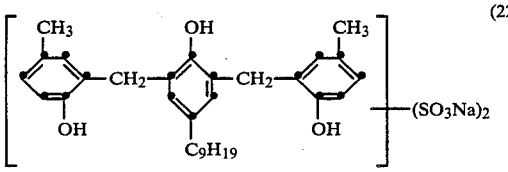

(22)

2.8% of the quaternary ammonium compound $B_6$,
1% of the siloxane/oxyalkylene copolymer (A),
10% of diethanolamine and
50.2% of water.

The formaldehyde condensate of formula (21) used in composition (2) is prepared as follows:

110 g of p-nonylphenol, 42 g of water and 89 g of formaldehyde (37%) are charged into an agitator flask. Then 24.6 g of 30% sodium hydroxide solution are stirred in over 15 minutes at an initial temperature of 20°-25° C. During this addition, the temperature rises to 35° C. The reaction mixture is heated to 60° C. and stirred for two hours at this temperature. The dimethylol compound is isolated by acidifying the reaction mixture with 20.75 g of 40% sulfuric acid to pH 6.8. The aqueous salt solution is separated from the dimethylol compound in a separating funnel.

Then 150 g of tert-butylphenol are fused at 98°-100° C. and 1.8 g of 37% hydrochloric acid are added. The dimethylol compound is added to this mixture over 15 minutes. The reaction mixture is then stirred for 4 hours at 98°-100° C. and the water of reaction is distilled off. To the hot reaction mixture of 85° C. are added 22 g of dimethylmethane phosphonate and 220 g of trichloroethylene and the reaction mixture is subsequently cooled to 45° C. Sulfonation is effected by adding 128 g of chlorosulfonic acid to this solution over 1 hour and stirring for 3 hours at 50° C. The sulfonation mixture is diluted with water and neutralised with 203 g of 30% NaOH. Trichloroethylene and a portion of the water are then distilled off. After determination of the solids content, the reaction product is diluted with a 3:2 mixture of water/ethanol to 40% solids content, giving a clear solution which is infinitely miscible with water and has a pH of 9.7. A. 0.1% solution (based on active ingredient) has a surface tension of 41.8 dyn/cm at 20° C.

EXAMPLE 3

100 kg of polyamide 66 carpet are impregnated at 20° C. in a winchbeck, equipped with metering devices for sodium hydroxide and sulfuric acid, with 3000 liters of water adjusted to pH 8. The following ingredients are then added to the liquor:

2500 g of an assistant composition (4) comprising
36% of the sulfonated melamine compound of the formula

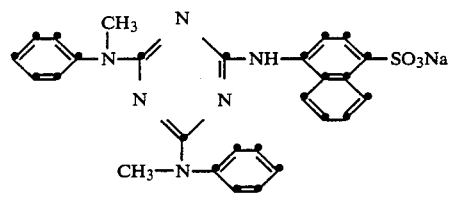

(23)

3% of the quaternary ammonium compound $B_3$
10% of propylene glycol and
51% of water,
300 g of a yellow dye of the formula (101),
400 g of a red dye of the formula (102) and
150 g of a blue dye mixture (1:1) consisting of a dye of the formula (103) and a dye of the formula

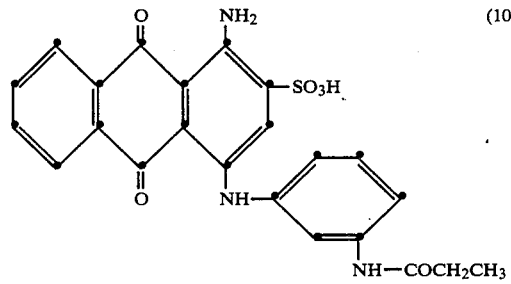

(104)

The goods are circulated for 15 minutes at 20° C. and the temperature is then raised over 40 minutes to 90° C.

Dyeing is carried out for 30 minutes at this temperature and the pH of the bath is lowered to 5 over the course of 40 minutes by adding sulfuric acid. Dyeing is then carried out for 15 minutes at 90° C. and pH 5. The dyebath is then cooled and the carpet is rinsed and finished.

A level dyeing of good penetration is obtained. The bath is almost completely exhausted, so that the next carpet may be dyed in the same dyebath.

A level, deep dyeing is obtained by using in this Example, instead of composition (4), the same amount of one of the compositions (5) to (8).

Composition (5) comprising:

36% of a sulfonated formaldehyde condensate of the formula

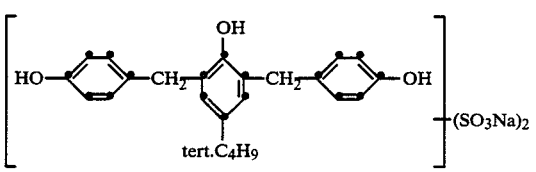

(24)

18% of the quaternary ammonium compound $B_7$,
10% of propylene glycol and
36% of water.

Composition (6) comprising:

36% of a sulfonated formaldehyde condensate of the formula

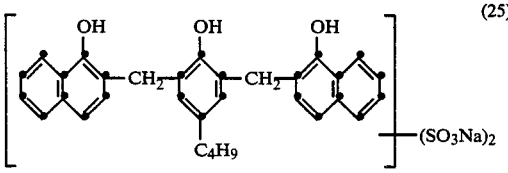

(25)

10% of the quaternary ammonium compound $B_6$
1% of the siloxane/oxyalkylene copolymer (A)
5% of propylene glycol
7% of 30% sodium hydroxide solution and
41% of water.

Composition (7) comprising:

36% of a sulfonated phenol/formaldehyde condensate, prepared in accordance with German Auslegeschrift No. 2 328 767, Example 8

18% of the quaternary ammonium compound $B_7$
10% of propylene glycol and
36% of water; or Composition (8) comprising:

30% of a sulfonated phenol/formaldehyde condensate of the formula

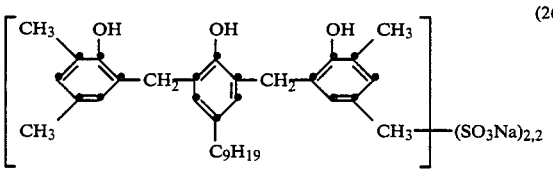

(26)

8.8% of the quaternary ammonium compound $B_8$
1% of the siloxane/oxyalkylene copolymer (A)
10% of propylene glycol and
43.2% of water.

The sulfonated compounds of the formulae (23) and (24) used in compositions (4) and (5) are prepared as follows.

Preparation of the sulfonated melamine compound of the formula (23):

55.2 g of cyanuric chloride are dissolved in 500 g of acetone and the solution is adjusted to pH 5 with 20% aqueous sodium carbonate solution. This solution is cooled to 0°–5° C. and then a solution of 94.5 g of 77.8% 1-naphthylamine-4-sulfonic acid, sodium salt, in 180 g of water is added dropwise over 1 hour, while keeping the pH at 5 by addition of further 20% sodium carbonate solution and keeping the temperature at a maximum of 5° C. by cooling. Stirring is then continued for 2 hours at 5° C.

The temperature is then allowed to rise to 15° C. and 70.6 g of N-methylaniline are added dropwise over 30 minutes at 15°–20° C., while keeping the pH at 5 by addition of 20% sodium carbonate solution. The reaction mixture is then stirred for 30 minutes at 20° C. and for 2 hours at 35° C. The acetone is distilled off by raising the temperature to 55°–60° C. The reaction mixture is then heated to 85° C. and the pH adjusted to 10 with 30% NaOH. The reaction product is filtered with suction, suspended repeatedly in isopropanol, washed with water and dried, affording a white powder.

| | Elemental analysis: | | | | |
|---|---|---|---|---|---|
| | C | H | N | S | Na |
| calculated | 55.74% | 4.3% | 14.4% | 5.5% | 5.9% |
| found | 55.0% | 4.4% | 14.8% | 6.0% | 4.29% |

Preparation of the sulfonated formaldehyde condensate of the formula (24): An agitator flask is charged with 97.5 g of tert-butylphenol, 54 g of water and 115.9 g of formaldehyde (37%). Then 32 g of 30% NaOH are stirred in over 15 minutes at an initial temperature of 20°–25° C. During the addition, the temperature rises to 30° C. The reaction mixture is heated to 60° C. and stirred for 2 hours at this temperature. The dimethylol compound is isolated by acidifying the reaction mixture with 27 g of 40% sulfuric acid to pH 6.8. The aqueous salt solution is then separated from the dimethylol compound.

Then 126.8 g of phenol are fused and 2.15 g of 37% hydrochloric acid are added. The dimethylol compound is added to this mixture over 15 minutes, whereupon the temperature rises to 85° C. The reaction mixture is then heated to 102° C. and stirred for 3 hours at this temperature, after which the water of reaction is distilled off. The temperature of the reaction mixture is lowered to 85° C. and 25 g of dimethylmethane phosphate and 300 g of trichloroethylene are added. The mixture is then cooled to 45° C. Sulfonation is carried out by adding 151.5 g of chlorosulfonic acid to this solution over 1 hour and stirring for 3 hours at 50° C. The reaction mixture is diluted with water and neutralised with 220 g of 30% NaOH. Then trichloroethylene and a portion of the water are distilled off. After determination of the solids content, the reaction product is diluted with water to a solids content of 50%, giving a clear solution which is infinitely miscible with water and has a pH of 7.5. A 0.1% solution (based on the active ingredient) has a surface tension of 33.3 dyn/cm at 20° C.

EXAMPLE 4

10 g of unlevel dyeing polyamide 66 knitted fabric are treated at 40° C. for 10 minutes in 400 ml of a liquor which has been adjusted to pH 6 with 0.8 g of monosodium phosphate and 0.2 g of disodium phosphate and which contains 0.1 g of the assistant composition (1). Then 0.03 g of a dye of the formula

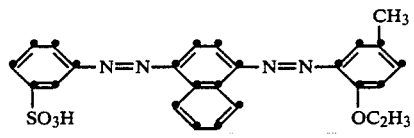

(105)

and 0.03 g of a dye of the formula

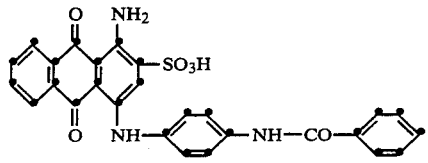

(106)

are added and the goods are agitated for 10 minutes at 40° C. The dye bath is then heated to boiling temperature over 30 minutes and dyeing is carried out for 30 minutes at this temperature. The bath is cooled and the dyed knitted fabric is rinsed with water and dried. A non-barry, level green dyeing of good fastness properties is obtained.

A level and strong dyeing is obtained by using in this Example the same amount of one of the following compositions (9) to (14).

Composition (9) comprising
- 35.5% of the sulfonated formaldehyde condensate of the formula (21)
- 4.5% of the quaternary ammonium compound $B_{14}$ and
- 60% of water.

Composition (10) comprising
- 26% of the sulfonated formaldehyde condensate of the formula (21)
- 14% of the quaternary ammonium compound $B_{15}$ and
- 60% of water.

Composition (11) comprising
- 30% of the sulfonated formaldehyde condensate of the formula (21)
- 10% of the quaternary ammonium compound $B_1$ and
- 60% of water.

Composition (12) comprising
- 35% of the sulfonated formaldehyde condensate of the formula (21)
- 15% of the quaternary ammonium compound $B_{18}$ and
- 50% of water.

Composition (13) comprising
- 25% of the sulfonated formaldehyde condensate of the formula (21)
- 5% of the quaternary ammonium compound $b_{16}$ and
- 10% of water.

Composition (14) comprising
- 36% of the sulfonated melamine compound of the formula

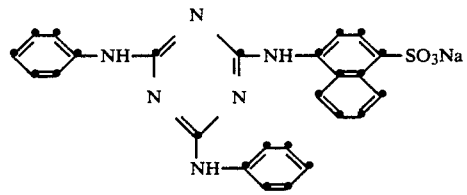

(27)

- 3% of the quaternary ammonium compound $B_6$
- 10% of propylene glycol and
- 51% of water.

EXAMPLE 5

Nylon 6 fabric is put into a liquor of 25° C. which contains
- 0.25 g/l of ammonium acetate
- 2.5% of the assistant composition (1)
- 2.2% of the 1:2 chromium complex of the dye of the formula

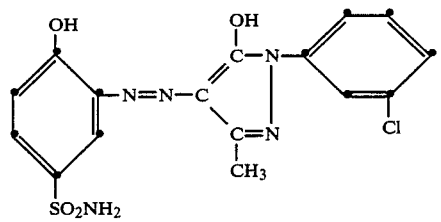

(107)

and which is adjusted with acetic to pH 5. The liquor ratio is 1:40. The bath is then heated to 96° C. over 30 minutes and dyeing is carried out for 1 hour at this temperature.

After the bath has cooled, the goods are rinsed and dried. A non-barry, orange dyeing of good fastness properties is obtained.

What is claimed is:

1. A dyeing assistant which comprises at least
(A) a sulfonated condensation product of a hydroxyaryl compound and formaldehyde or a sulfonated N-arylmelamine derivative, and
(B) a quaternary ammonium compound which contains a basic nitrogen atom to which is attached at least one polyglycol ether chain and at least one aliphatic radical of 10 to 22 carbon atoms, said polyglycol ether chain containing at least one grouping of the formula

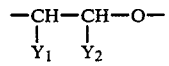

wherein one of $Y_1$ and $Y_2$ is hydrogen and the other is phenyl.

2. A dyeing assistant according to claim 1, which further comprises a siloxane/oxyalkylene copolymer as component (C).

3. A dyeing assistant according to claim 1, which further comprises a polar solvent as component (D).

4. A dyeing assistant according to claim 1, which contains components (A), (B), (C) and (D) together.

5. A dyeing assistant according to claim 1, wherein component (A) is a sulfonated formaldehyde condensate of the formula

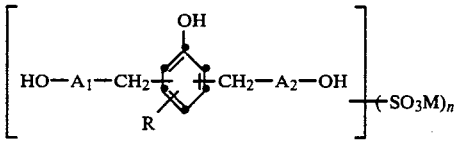

wherein each of $A_1$ and $A_2$ independently of the other is naphthylene or a phenylene radical which is unsubstituted or substituted by halogen, alkyl, cycloalkyl, aryl or aralkyl, R is halogen, alkyl, cycloalkyl, aryl or aralkyl, M is hydrogen or a salt-forming cation and n is a value from 1 to 3.

6. A dyeing assistant according to claim 5, wherein component (A) is a sulfonated formaldehyde condensate of the formula

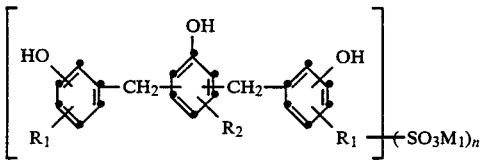

wherein each of $R_1$ and $R_2$ independently of the other is halogen, $C_1$–$C_{12}$alkyl, cyclohexyl, benzyl or phenyl, and $R_1$ is also hydrogen, $M_1$ is hydrogen, an alkali metal or ammonium, and n is a value from 1 to 3.

7. A dyeing assistant according to claim 6, wherein $R_1$ is hydrogen or $C_1$–$C_9$-alkyl, $R_2$ is $C_1$–$C_9$alkyl, and $M_1$ is hydrogen, sodium, potassium or ammonium.

8. A dyeing assistant according to claim 7, wherein $R_1$ is tert-butyl.

9. A dyeing assistant according to claim 1, wherein component (A) is a sulfonated melamine compound of the formula

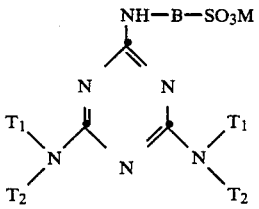

wherein B is an $\alpha$- or $\beta$-napthylene radical, $T_1$ is hydrogen or $C_1$–$C_5$alkyl, $T_2$ is phenyl or phenyl substituted by halogen, $C_1$–$C_4$alkyl or $C_1$–$C_4$alkoxy, and M is hydrogen or a salt-forming cation.

10. A dyeing assistant according to claim 1, wherein the quaternary ammonium compound contains two polyglycol ether chains, which together contains 4 to 200 polyether groupings.

11. A dyeing assistant according to claim 10, wherein the polyglycol ether chains together contain one or two groupings of the formula

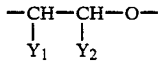

wherein one of $Y_1$ and $Y_2$ is hydrogen and the other is phenyl.

12. A dyeing assistant according to claim 1, wherein component (B) is a quaternary ammonium compound which is prepared by reaction of an aliphatic mono-, di- or triamine, the aliphatic moiety of which contains 10 to 22 carbon atoms, with 1 to 2 moles of styrene oxide and 1 to 45 moles of an alkylene oxide, and subsequent quaternization of the reaction product with a quaternizing agent.

13. A dyeing assistant according to claim 1, wherein component (B) is a quaternary ammonium compound of the formula

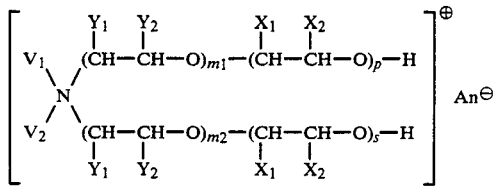

wherein $V_1$ is alkyl or alkenyl, each of 10 to 22 carbon atoms, $V_2$ is alkyl of 1 to 4 carbon atoms, hydroxyalkyl of 2 to 4 carbon atoms, carbamoylmethyl or benzyl; one of $Y_1$ and $Y_2$ is hydrogen and the other is phenyl; one of $X_1$ and $X_2$ is hydrogen or methyl and the other is hydrogen; $An^{\ominus}$ is the anion of an inorganic or organic acid, $m_1$ and $m_2$ are 0 or 1 and p and s are whole numbers, the sum of p+s being from 2 to 40.

14. A dyeing assistant according to claim 13, wherein $V_1$ is alkyl or alkenyl, each of 12 to 18 carbon atoms, $X_1$ and $X_2$ are hydrogen, one of $m_1$ and $m_2$ is 1 and the other is 0, and the sum of p+s is from 5 to 25.

15. A dyeing assistant according to claim 1, which comprises at least (Aa) a sulfonated formaldehyde condensation product of the formula

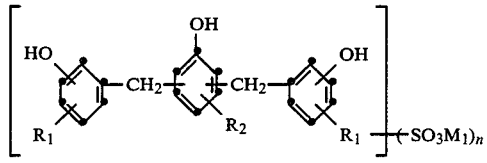

wherein each of $R_1$ and $R_2$ independently of the other is halogen, $C_1$–$C_{12}$alkyl, cyclohexyl, benzyl or phenyl, and $R_1$ is also hydrogen, $M_1$ is hydrogen, an alkali metal or ammonium, and n is a value from 1 to 3 and (Bb) a quaternary ammonium compound of the formula

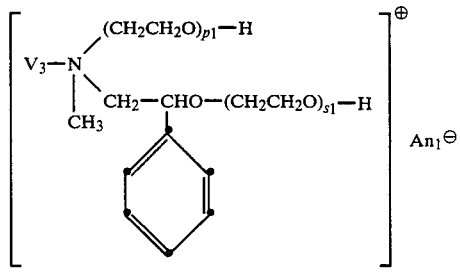

wherein $V_3$ is octadecyl or octadecenyl and $An_1^{\ominus}$ is the chloride, bromide, methanesulfonate or ethanesulfonate ion, and the sum of $p_1+s_1$ is from 15 to 25.

16. A dyeing assistant according to claim 2, wherein component (C) is a polyether siloxane having a cloud point of 20° to 70° C.

17. A dyeing assistant according to claim 3, wherein component (D) is water.

18. A dyeing assistant according to claim 1, which comprises 15 to 70% by weight of component (A),
2 to 30% by weight of component (B),
0 to 5% by weight of component (C),
0 to 70% by weight of component (D), and
0 to 15% by weight of a base,
in each case based on the weight of the entire composition.

19. A process for dyeing or printing synthetic polyamide fibre material with anionic dyes, which process comprises dyeing or printing said material in the presence of an assistant which comprises at least (A) a sulfonated condensation product of a hydroxyaryl compound and formaldehyde or a sulfonated N-arylmelamine derivative, and (B) a quaternary ammonium compound which contains a basic nitrogen atom to which is attached at least one polyglycol ether chain and at least one aliphatic radical of 10 to 22 carbon atoms, said polyglycol ether chain containing at least one grouping of the formula $$-\underset{\underset{Y_1}{|}}{CH}-\underset{\underset{Y_2}{|}}{CH}-O-$$

wherein one of $Y_1$ and $Y_2$ is hydrogen and the other is phenyl.

20. A process according to claim 19, wherein the assistant is used in an amount of 1 to 10% by weight, based on the weight of the material to be dyed.

21. A process according to claim 19, wherein dyeing is carried out in the temperature range from 60° to 96° C.

22. A process according to claim 19, wherein the pH of the dyebath is 4.5 to 8.5.

23. A process according to claim 19, wherein the dyebath is used again any number of times after the dyeing procedure by adding further anionic dye and the components (A) and (B).

* * * * *